United States Patent [19]

Scheler et al.

[11] 4,207,110

[45] Jun. 10, 1980

[54] DIAZOTYPE MATERIAL

[75] Inventors: Siegfried Scheler; Heinz Schäfer, both of Wiesbaden, Fed. Rep. of Germany

[73] Assignee: Hoechst Aktiengesellschaft, Fed. Rep. of Germany

[21] Appl. No.: 951,247

[22] Filed: Oct. 13, 1978

[51] Int. Cl.[2] ..... G03C 1/52

[52] U.S. Cl. ..... 430/173; 430/148

[58] Field of Search ..... 96/91 R, 75

[56] References Cited

U.S. PATENT DOCUMENTS

| | | | |
|---|---|---|---|
| 2,233,038 | 2/1941 | Süs et al. | 96/91 R |
| 2,542,560 | 2/1943 | Neumann | 96/91 R |
| 2,545,057 | 3/1951 | von Glahn et al. | 96/91 R |
| 2,717,832 | 9/1955 | Sulich | 96/91 R |
| 3,971,663 | 7/1976 | Bialczak | 96/91 R |

FOREIGN PATENT DOCUMENTS

| | | | |
|---|---|---|---|
| 1772980 | 7/1968 | Fed. Rep. of Germany | 96/75 |
| 1259849 | 1/1972 | United Kingdom | 96/75 |

*Primary Examiner*—Won H. Louie, Jr.
*Attorney, Agent, or Firm*—James E. Bryan

[57] ABSTRACT

This invention relates to an improvement in a diazotype material comprising, in the light-sensitive layer, a diazo component and a coupling component which yields a black dyestuff image, the improvement that the diazo component is a 2,5-dialkoxy-4-morpholino-benzene diazonium salt and the coupling component is a combination of (a) 6-methoxy-2-hydroxy-3-naphthoic acid-N(ω-aminoalkyl)-amide as a blue coupler, (b) a 2-alkyl- or 2-aryl-1,3-dihydroxybenzene or a cyanoacetoamide as a yellow coupler, and (c) at least one compound of the general formula

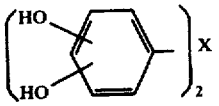

wherein

X is zero, =S, =SO, or $=SO_2$, as a reddish-brown coupler, the molar ratio of blue coupler to yellow coupler being in the range of about (0.7 to 0.9):1, and the molar ratio of blue coupler to reddish-brown coupler being in the range of about (6 to 12):1.

4 Claims, No Drawings

DIAZOTYPE MATERIAL

The present invention relates to a diazotype material which contains, in its light-sensitive layer, a diazo component and a coupling component yielding a black image.

Diazotype materials are composed of a support and a light-sensitive layer applied to the support, the light-sensitive layer substantially comprising a diazo component and a coupling component which are capable of forming an azo dyestuff with each other, by coupling. If a material of this type is exposed under an original, the diazo component is destroyed in the areas struck by radiation. By subsequent treatment of the latent copy thus produced with a basic medium, such as wet ammonia gas, dry ammonia gas, or an alkaline solution, the coupling reaction of the undestroyed diazo component with the coupling component is effected, the azo dyestuff being formed in the unexposed areas formerly covered by the original.

Whereas hitherto mainly diazotype materials were used which yielded copies with blue or purple color shades after imagewise exposure and development, there is now a demand for diazotype materials by means of which copies with black color shades can be produced which, insofar as possible, should compare with the color shades known from photographic copies.

Thus, a two-component diazotype material is known from German Auslegeschrift No. 1,923,115, which yields a black image during wet development. The light-sensitive layer of this material contains two coupling components, one of which forms a blue dyestuff when used alone, whereas the other forms a yellow dyestuff when used alone. The diazo component used is 4-diazo-2,5-dialkoxy-phenylmorpholine, and the blue-coupling component is a substituted 2-hydroxy-3-naphthoic acid-N(ω-aminoalkyl)-amide which is used in combination with a 1-biguanidino-naphthol. Acetoacetic amide is used as the yellow coupler.

Further, it is known from German Auslegeschrift No. 1,772,980, to prepare black copies by using a multi-component diazotype material which contains a 4-morpholino-benzene diazonium salt or a 2,5-dialkoxy-4-morpholino-benzene diazonium salt as the diazo compound and blue and yellow couplers as coupling components.

Generally, the known black-coupling diazotype materials produce copies with satisfactory sensitometric and practical properties. However, when these materials are developed by the different methods used today in the photoprinting field, e.g. development with wet ammonia gas, development with dry ammonia gas under pressure, and development with alkaline solutions at different temperatures, a development of the same material leads to differences in color shades which in some cases are rather substantial. Thus, for example, copies with black color shades may be obtained by conventional development with wet ammonia gas at elevated temperatures, whereas the copies produced by development with dry ammonia gas under pressure show sepia shades. Similar differences in color shades may occur when a diazotype material of this type is developed with wet ammonia gas at different temperatures. This is frequently the case in photoprinting practice if a material is to be processed at different developing temperatures either in the same or in several developing apparatuses. In this case, copies with different color shades are obtained, which means that the copies differ in their suitability as generation copies, in their gradation, and in their visual and actinic density. Copies of this type are limited in their usefulness for practical applications.

As a further drawback of these black-line diazotype materials, copies with non-uniform color shades may be obtained from originals differing in thickness, especially from continuous tone originals. Due to their non-uniform spectral properties, such two-tone copies are unsuitable for many purposes. This is in particular the case when one or more generation copies are to be produced on the same diazotype material from a transparent diazo copy, i.e., from a diazotype intermediate. If the information contained on the diazotype intermediate is in very small type, as in the case of diazo microfilm copies, serious losses of detail may already occur in the first diazo generation, and will most certainly occur in the second and third diazo generations, due to intensification or weakening.

It is the object of the present invention to provide a diazo-type material which yields copies in a black color shade and by means of which copies with highly identical black color shades and good color stability may be obtained under varying conditions of development.

This object is achieved by a diazotype material comprising, in the light-sensitive layer, a diazo component and a coupling component yielding a black color image. The diazotype material contains, as the diazo component, a 2,5-dialkoxy-4-4-morpholino-benzene diazonium salt, and as the coupling component, a combination of (a) 6-methoxy-2-hydroxy-3-naphthoic acid-N(ω-amino-alkyl)-amide as a blue coupler, (b) a 2-alkyl- or 2-aryl-1,3-dihydroxy-benzene or a cyano acetoamide as a yellow coupler, and (c) a compound corresponding to the general formula

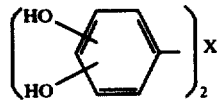

wherein X is zero, =S, —SO, or $=SO_2$, as the reddish brown coupler, the molar ratio of blue coupler to yellow coupler being in the range of approximately (0.7 to 0.9):1, and the molar ratio of blue coupler to reddish-brown coupler being in the range of approximately (6 to 12):1. Preferably the molar ratios of blue and yellow couplers are about 0.8 to 1, and the molar ratios of blue and reddish-brown couplers are about 8:1.

The molar proportion between diazo component and coupling component advantageously is within the range of about 1:(1.1 to 1.4). A molar ratio of 1:1.3 was found to be particularly favorable.

In this manner, a diazotype material is provided in which the components are present in a well-balanced proportion and which yields copies with dark-violet to blue-tinged black, i.e. altogether black, color shades, irrespective of the developing method employed, either by wet or by dry ammonia gas, or by means of an alkaline solution, under varying conditions of pressure and temperature. In addition thereto, the copies display a very good visual contrast, a mean to flat gradation, and are capable of yielding good generation copies. Finally, the diazotype material according to the invention is distinguished by its excellent storability and by its universal applicability.

In a preferred embodiment of the invention, the diazo component additionally contains a 4-(dialkylamino)-benzene diazonium salt, the proportion of 2,5-dialkoxy-4-morpholino benzene diazonium salt to 4-(dialkylamino)-benzene diazonium salt being in the range of about (5 to 7):1. A molar ratio of about 6.5 to 1 was found to be particularly favorable.

By this addition, the dark-violet to blue-tinged black color shade of the copies is displaced towards a neutral black, i.e., a color shade similar to that known from silver photography.

If diazotype materials are to be prepared which produce almost identical color shades under different conditions of development, care must be taken that the molar ratio of blue coupler to yellow coupler is observed. If the proportion of blue coupler per part of yellow coupler is substantially increased, a blue-tinged color shade is produced. On the other hand, if the molar ratio of blue coupler to yellow coupler falls below the above stated limit, coupling produces a somewhat yellow-greenish dark color shade. Similar changes occur when the molar ratio between blue coupler and reddish-brown coupler is outside the above-mentioned limits. If the proportion of blue coupler is increased beyond these limits, coupling produces a green-tinged blue color shade, and if this proportion falls below the lower limit, coupling produces a violet-tinged blue color shade. Higher concentrations of coupler may lead, e.g., to an unnecessary excess of non-reacted coupling component and thus are not advisable. Therefore, the molar ratio of diazo component to coupling component should preferably lie within the above-mentioned range.

The 2,5-dialkoxy-4-morpholino-benzene diazonium salts suitable for the preparation of the light-sensitive diazotype material according to the invention may be defined by the following structural formula (I):

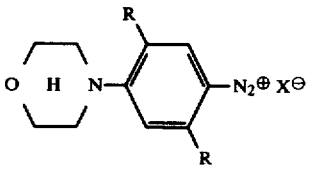

(I)

wherein

R is an alkoxy group with 1 to 6, preferably 2 to 4 carbon atoms, and

X is the anion, for example a chlorozincate, fluoborate, or hexafluophosphate anion.

A compound corresponding to the above Formula I, wherein R is n-butoxy and X is the fluoborate anion, may be used with particular advantage.

The 4-(dialkylamino)-benzene diazonium compound is defined by the following structural formula (II):

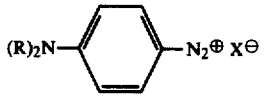

(II)

wherein

R is an alkyl group with 1 to 6, preferably with 1 to 3 carbon atoms, and

X is an anion of the type mentioned above.

A compound in which R is n-propyl and X is the fluoborate anion may be used with particular advantage.

The blue coupler used for the preparation of the diazotype material according to the invention is defined by the following structural formula (III):

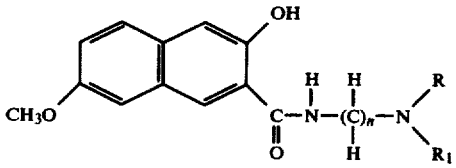

(III)

wherein

R and $R_1$, which may be the same or different, are hydrogen, or a short-chain alkyl group or hydroxy alkyl group with 1 to 8, preferably 1 to 4, carbon atoms, or, together with the nitrogen atom to which they are attached, form a heterocyclic ring with 5 to 8 members, and n—is a whole number between 2 and 5, preferably 3.

The yellow couplers used for the preparation of the diazo-type material according to the invention may be defined by the following structural formulae (IV) and (IVa):

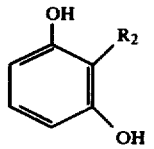

(IV)

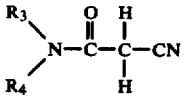

(IVa)

wherein $R_2$ is alkyl with 1 to 4 carbon atoms, especially methyl or aryl, which may be substituted, and preferably phenyl, and $R_3$ and $R_4$, which may be the same or different, are an alkyl group with 1 to 6, preferably 1 to 3, carbon atoms, substituted or unsubstituted aryl, especially methoxyphenyl or benzyl or aralkyl groups which may be substituted, or, together with the nitrogen atom to which they are attached, form a heterocyclic ring with 5 to 8 members, especially a morpholino group.

Suitable reddish-brown couplers are, for example: tetrahydroxy diphenyl, tetrahydroxy diphenylsulfide, tetrahydroxy diphenylsulfoxide, and tetrahydroxy diphenylsulfone.

In a particularly advantageous embodiment of the invention, the diazotype material according to the invention contains in its light-sensitive layer 2,5-dibutoxy-4-morpholino-benzene diazonium fluoborate and 4-(dipropylamino)-benzene diazonium fluoborate, 6-methoxy-2-hydroxy-3-naphthoic acid-N(3-morpholinopropyl)-amide, 2-methyl-1,3-dihydroxy-benzene, and 2,2',4,4'-tetrahydroxy-diphenyl sulfide.

When using a mixture of diazonium salts, it is also possible to control the color shade by the diazo component. Such a diazo-type material has an almost identical light-sensitivity, but is distinguished by its insensitivity to different developing procedures and differences in the conditions of development. Copies prepared from this material show virtually identical color shades of a completely neutral black after development.

The diazonium salts and coupling components used in connection with the present invention are known compounds which are conventionally used. Normally, the diazotype composition is applied to the support in the form of a solution of the various components in a solvent or a solvent mixture. After drying, the resulting light-sensitive layer may be imagewise exposed and developed in known manner.

Preferably, the diazotype components are applied to the support from an organic medium containing a film-forming binder. The concentration of the components forming the azo dyestuff in the binder may vary between about 15 and 30 parts by weight per 100 parts by weight of binder.

Examples of suitable binders are cellulose ethers, such as ethyl cellulose; cellulose esters, such as cellulose acetate, cellulose triacetate, cellulose acetopropionate, cellulose butyrate, and cellulose acetobutyrate; vinyl polymers, such as polyvinyl acetate, polyvinylidene chloride, and vinyl chloride/vinyl acetate copolymers; poly-(methacrylate)-copolymers of alkyl acrylates and acrylic acid, or polyphenylene oxide, or ethyleneglycol/isophthalic acid/terephthalic acid terpolymers.

In addition to the components forming the dyestuff, the light-sensitive layer may contain acid stabilizers and other diazo-type auxiliaries. Suitable cold stabilizers which prevent a premature coupling of the diazonium salts with the coupling components are organic acids, such as 5-sulfo-salicylic acid. Preferably, the organic acids used for stabilization are applied in concentrations of about 4 to 8 parts by weight per 100 parts by weight of binder. In addition thereto, metal salts, such as zinc chloride, may be present which in addition to their stabilizing effect, contribute to the improvement of the contrast of the developed copy. Furthermore, substances which accelerate development may be added to the light-sensitive layer. Such substances are, for example, carboxylic acid esters of aliphatic and aromatic mono- and dicarboxylic acids and monohydric lower aliphatic alcohols, and esters of carboxylic acids and polyhydric aliphatic alcohols. Preferably, the glycerol esters of lower aliphatic acids, e.g. glycerol diacetate and glycerol triacetate, are used. Furthermore, it is possible to add hygroscopic substances, such as glycol, glycerol and the like, in order to control the conditions of humidity within the light-sensitive layer, or suitable dyestuffs in a low concentration, e.g. methyl violet, in order to improve the quality of the exposed areas of the copy. In addition thereto, so-called anti-yellowing agents, e.g. thiourea or thiourea derivatives, may be added to the light-sensitive layer in order to prevent a yellowing of the exposed areas of the copy. In order to improve the slip of superimposed and unexposed or developed sheets of copying material, inorganic pigments in the form of fine particles, e.g. silica or aluminum oxide and the like, may be added as so-called slip agents.

Suitable supports for the light-sensitive layers are all conventional supports, e.g. coated or uncoated, opaque or transparent papers, textiles, cellulose esters, such as cellulose-2½-acetate and cellulose triacetate, polyesters such as polyethylene terephthalate, vinyl polymers such as polyvinyl acetate, or polystyrene. If desired, the light-sensitive layer may be in the form of a self-supporting layer, which means that it is not absolutely necessary to apply the coating mass to a support and attach it thereto.

It was found to be advantageous to apply the coating to the support in a manner such that a visual optical density of about 1 to 2.5 is achieved after development of the light-sensitive layer. If the visual optical density is below 1.0, the diazotype material thus prepared normally yields copies with a contrast which is so low that it is unsuitable for practical purposes. On the other hand, if the visual optical density exceeds 2.5, the diazotype material normally is not light-sensitive enough and the copies produced by imagewise exposure and development show a contrast which is too strong, so that, if a transparent support was used, the suitability of these diazo copies for generation copies is very much restricted.

The invention will be further illustrated by the following examples.

EXAMPLES

Remarks:

A. A base stock (BL) composed of 7.5 percent by weight of cellulose acetopropionate in a mixture of acetone, methanol, butanol, and ethyleneglycol monomethyl ether is used for the diazotype materials prepared in the examples.

B. The diazotype materials prepared according to the examples are developed by three different developing methods (EV 1, EV 2, EV 3) and the resulting color shades are visually compared. Method 1 (EV 1) is a development with wet ammonia gas at a temperature of 60° to 70° C., Method 2 (EV 2) is a development with dry ammonia gas under pressure at a temperature of 20° to 25° C., and Method 3 (EV 3) is a development in an alkaline developer solution at 40° to 45° C. (bath development). The alkaline developer solution (EL) is composed of ethanolamine, water, and an alkylphenol polyglycol ether as a wetting agent.

EXAMPLE 1

Six different coating solutions of the following composition are prepared:

100 ml—of the base stock above,
372 mg—of sulfosalicylic acid,
153 mg—of zinc chloride,
168 mg—of thiourea,
600 mg—of glycerol triacetate,
75 mg—of 2,5-dibutoxy-4-morpholinobenzenediazonium fluoborate,
153 mg—of 2-methyl-resorcinol,
30 mg—of 2,2',4,4'-tetrahydroxy-diphenylsulfide, and
$0.975 \times 10^{-3}$ mole of a blue coupler.

The following known substances are added to these solutions as blue couplers:

6-methoxy-2-hydroxy-3-naphthoic acid-N(3-morpholinopropyl)-amide (BK 1),
2-hydroxy-3-naphthoic aic-N(3-morpholinopropyl)-amide (BK 2),
2-hydroxy-3-naphthoic acid-N(2-methylphenyl)-amide (BK 3),
2-hydroxy-3-naphthoic acid-N(2-methoxyphenyl)-amide (BK 4),
2-hydroxy-3-naphthoic acid-N(2,4-dimethoxy-5-chlorophenyl)-amide (BK 5), and
6-bromo-2-hydroxy-3-naphthoic acid-N(3-morpholinopropyl)-amide (BK 6).

Each of these solutions is then applied to a polyethylene terephthalate support provided with an adhesive layer, in such a manner that the dried diazotype materials obtained can be developed to an optical density in the solid areas of about 1.8 to 2.0, measured with a green filter (Kodak Wratten NR 93).

The solids content of the individual solutions is between 8.5 and 9.0 percent by weight.

Of each of the diazotype materials thus obtained, a first section is developed by the developing method EV 1, a second section by the developing method EV 2, and a third section by the developing method EV 3. The color shades produced are visually judged by transmitted light.

From the data compiled in the following table, it follows that only the inventive combination of diazonium salt, blue coupler, yellow coupler, and reddish-brown coupler, i.e. the diazotype material according to Solution 1, produces the same bluish-black dyestuff upon development by the three different methods.

TABLE

| Diazotype Material of Solution | Molecular weight of Blue Coupler | Color Shade Produced By: | | |
|---|---|---|---|---|
| | | EV 1 | EV 2 | EV 3 |
| 1 | 344 | bluish black | bluish black | bluish black |
| 2 | 312 | violet | violet | violet |
| 3 | 277 | violet | brown | violet |
| 4 | 293 | violet | brown | violet |
| 5 | 357.5 | violet | brown | violet |
| 6 | 393 | blue | brown | violet |

Results of similarly good quality are obtained by using a blue coupler of type BK 1 in which the basic morpholino propyl group is replaced by one of the following groups:

morpholino ethyl,
morpholino pentyl,
pyrrolidino ethyl,
diethylamino ethyl,
hydroxy ethyl amino ethyl, and
aminoethyl.

When the blue couplers of types BK 2 and BK 6 are substituted by corresponding groups, no uniform black color shades are produced. When blue couplers of types BK 3, 4, and 5, are used in which the aromatic group of the carbonamide group is substituted not only by methyl, methoxy and chlorine, but by such groups as ethoxy,
trifluoromethyl,
carbonamide,
sulfamide,
nitro,
dimethyl,
diethylamino,
hydroxy, or
fluorine or bromine, one substituent or several identical or different substituents being possibly present in the aromatic carbonamide group, no black color shades are produced.

The blue couplers of types BK 1, 2, or 6, are obtained in known manner by aminolysis of 2-hydroxy-3-naphthoic acid methyl ester and 6-methoxy- or 6-bromo-2-hydroxy-3-naphthoic acid methyl ester with appropriately N,N-disubstituted alkylene diamines.

The blue couplers of types BK 3, 4, and 5, are obtained in known manner by aminolysis of 2-hydroxy-3-naphthoic acid chlorides with the appropriate nucleus-substituted aniline derivatives.

EXAMPLE 2

372 mg of sulfosalicylic acid,
153 mg of zinc chloride,
162 mg of thiourea,
153 mg of 2-methyl-resorcinol,
30 mg of 2,2',4,4'-tetrahydroxy-diphenylsulfide,
336 mg of 6-methoxy-2-hydroxy-3-naphthoic acid-N(3-morpholinopropyl)-amide,
600 mg of glycerol triacetate,
660 mg of 2,5-dibutoxy-4-morpholinobenzene-diazonium-fluoborate, and
70 mg of 4-(dipropylamino)-benzene diazonium fluoborate are dissolved in 100 ml of the above-identified base stock. The solids content of the solution is 10 percent by weight.

The solution is applied to a polyethylene terephthalate film with an adhesive layer as described in Example 1 and is then dried. Then, three sections of an identical size of about 10 $cm^2$ are cut from the diazotype material thus obtained and each of these samples is exposed under a silver halide original until the background is completely exposed and has a visual optical density of 0.07. The imagewise exposed sections 1, 2, and 3, are then developed by the developing methods EV 1, EV 2, EV 3.

For visual evaluation of the color shade, the diazo film copies thus produced are studied under transmitted light. It can be seen that the unexposed areas of the three diazofilm sections were developed into neutral black dyestuffs which show only very slight variations in their color shades.

If the molar ratio of 2,5-dibutoxy-4-morpholino-benzene diazonium fluoborate and 4-(dipropylamino)-benzene diazonium fluoborate is changed to about 1:1, by using 380 mg of 2,5-dibutoxy-4-morpholino-benzene diazonium fluoborate and 260 mg of 4-(dipropylamino)-benzene diazonium fluoborate, diazo copies with brown color shades result. If the molar ratio between 2,5-dibutoxy-4-morpholino-benzene diazonium fluoborate and 4-(dipropylamino)-benzene diazonium fluoborate is increased to about 15:1, diazo copies with blue color shades are obtained.

Neutral black color shades are also obtained if 2,5-dibutoxy-4-morpholino-benzene diazonium fluoborate is replaced by 2,5-diethoxy-4-morpholino-benzene-diazonium fluoborate and 4-(dipropylamino)-benzene diazonium fluoborate is replaced by 4-(diethylamino)-benzene diazonium fluoborate.

EXAMPLE 3

372 mg of sulfosalicylic acid,
162 mg of thiourea,
153 mg of zinc chloride,
153 mg of 2-methyl-resorcinol,
30 mg of 2,2',4,4'-tetrahydroxy-diphenyl-sulfide,
336 mg of 6-methoxy-2-hydroxy-3-naphthoic acid-N(3-morpholinopropyl)-amide,
600 mg of glycerol triacetate,
660 mg of 2,5-dibutoxy-4-morpholino-benzene-diazonium fluoborate, and
70 mg of 4-(dipropylamino)-benzene diazonium fluoborate are dissolved in 100 ml of the base stock. The resulting solution has a solids content of 10 percent by weight.

The molar ratio of blue coupler 6-methoxy-2-hydroxy-3-naphthoic acid-N(3-morpholinopropyl)-amide to yellow coupler 2-methyl-resorcinol is 0.8 to 1.

The solution is applied to a polyethylene terephthalate film carrying an adhesive layer and is then dried.

Preparation, development, and evaluation of the diazo film copies are as in Example 2. Diazo film copies with dyestuff images of a neutral black are obtained whose color shades differ only slightly from each other.

If the molar ratio of blue coupler to yellow coupler is increased to 1.75:1, diazo copies with reddish-blue dyestuff images result.

If the molar ratio of blue coupler to yellow coupler is reduced to 0.5:1, diazo copies with greenish-brown dyestuff images result.

Similar results, i.e. dyestuff images of a neutral black, are obtained when the blue coupler is replaced by the compounds of type BK 1, mentioned in Example 1, and the yellow coupler is replaced by 2phenyl-resorcinol or cyanoacetic acid-N(4-methoxyphenyl)-amide.

EXAMPLE 4

372 mg of sulfosalicylic acid,
162 mg of thiourea,
153 mg of zinc chloride,
600 mg of glycerol triacetate,
153 mg of 2-methyl-resorcinol,
30 mg of 2,2',4,4'-tetrahydroxy-diphenylsulfide,
360 mg of 6-methoxy-2-hydroxy-3-naphthoic acid-N-(3-morpholinopropyl)-amide,
600 mg of 2,5-dibutoxy-4-morpholino-benzene-diazonium fluoborate, and
70 mg of 4-(dipropylamino)-benzene diazonium fluoborate are dissolved in 100 ml of the base stock. The solids content of the resulting solution is 10 percent by weight.

The molar ratio of 6-methoxy-2-hydroxy-3-naphthoic acid-N(3-morpholino-propyl)-amide to 2,2',4,4'-tetrahydroxy-diphenylsulfide is 8:1.

The solution is applied to a polyethylene terephthalate film carrying an adhesive layer and dried as described in Example 2. The film is then imagewise exposed and developed as described in Example 2.

Diazo film copies with dyestuff images of a neutral black are obtained by the different developing methods, and their color shades differ only slightly from each other.

If the molar ratio of blue coupler to reddish-brown coupler is reduced to 4:1, developing method 1 (EV 1) produces greenish-black dyestuff images, and developing methods 2 and 3 (EV 2 and EV 3) produce violet-tinged black dyestuff images.

If the molar ratio of blue coupler is reddish-brown coupler is increased to 25:1, developing method 1 (EV 1) yields violet-tinged black dyestuff images, and developing methods 2 and 3 (EV 2 and EV 3) yield greenish-tinged black dyestuff images.

Similar, good results are obtained when the blue coupler is replaced by the compounds of type BK 1 mentioned in Example 1 and the reddish-brown coupler is replaced by 2,2',4,4'-tetrahydroxy-diphenyl, 2,2',4,4'-tetrahydroxy-diphenyl-sulfoxide, or 2,2',4,4'-tetrahydroxy-diphenyl-sulfone.

EXAMPLE 5

A naturally transparent paper conventionally used for diazo-printing purposes is coated, on one surface, with the following solution and then dried:

100 ml of the base stock,
372 mg of sulfosalicylic acid,
162 mg of thiourea,
153 mg of zinc chloride,
600 mg of glycerol triacetate,
1.5 mg of methyl violet,
153 mg of 2-methyl-resorcinol,
30 mg of 2,2',4,4'-tetrahydroxy-diphenylsulfide,
336 mg of 6-methoxy-2-hydroxy-3-naphthoic acid-N(3-morpholinopropyl)-amide,
660 mg of 2,5-dibutoxy-4-morpholino-benzene-diazonium fluoborate, and
70 mg of 4(dipropylamino)-benzene diazonium fluoborate.

The solids content of the solution is 10 percent by weight.

The solution is applied to the transparent support in such a manner that, after drying and development of the diazotype layer with wet ammonia gas, a maximum visual optical density of 1.70 is achieved.

The diazotype material prepared in this manner is imagewise exposed in a commercially available photoprinting apparatus and developed.

A diazo copy with dyestuff images of a neutral black is thus obtained which is extremely rich in contrast. Because the dyestuffs readily absorb the actinic radiation emitted by conventional photoprinting lamps, the diazo copy thus obtained is excellently suitable as an intermediate original from which further diazo copies may be produced.

EXAMPLE 6

A conventional photoprinting base paper provided with a precoat of colloidal silica and polyvinyl acetate was coated, on the pretreated surface, with a filtered solution of the following composition:

100.00 ml of water,
1.00 g of citric acid,
1.25 g of thiourea,
0.38 g of 2-methyl-resorcinol,
0.075 g of 2,2',4,4'-tetrahydroxy-diphenylsulfide,
0.85 g of 6-methoxy-2-hydroxy-3-naphthoic acid-N(3-morpholinopropyl)-amide, and
1.72 g of 2,5-dibutoxy-4-morpholino-benzene-diazonium hydrogen sulfate.

The thus sensitized paper was dried and then imagewise exposed under a transparent original and developed with wet ammonia gas in a commercial photoprinting apparatus. Dyestuff images of a neutral black were obtained.

It will be obvious to those skilled in the art that many modifications may be made within the scope of the present invention without departing from the spirit thereof, and the invention includes all such modifications.

What is claimed is:

1. In a diazotype material comprising, in the light-sensitive layer, a diazo component and a coupling component which yields a black dyestuff image, the improvement that the diazo component is a 2,5-dialkoxy-4-morpholino-benzene diazonium salt and the coupling component is a combination of (a) 6-methoxy-2-hydroxy-3-naphthoic acid-N(ω-aminoalkyl)-amide as a blue coupler,
(b) a 2-alkyl- or 2-aryl-1,3-dihydroxybenzene or a cyanoacetoamide as a yellow coupler, and
(c) at least one compound of the general formula

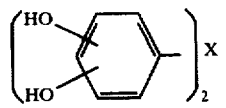

wherein x is zero, =S, =SO, or $=SO_2$, as a reddish-brown coupler, the molar ratio of blue coupler to yellow coupler being in the range of about (0.7 to 0.9):1, and the molar ratio of blue coupler to reddish-brown coupler being in the range of about (6 to 12):1.

2. Diazotype material according to claim 1 in which the molar ratio of diazo component to coupling component is in the range of about 1:(1.1 to 1.4).

3. Diazotype material according to claim 1 in which the diazo component additionally contains a 4-(dialkylamino)-benzene diazonium salt, the molar ratio of 2,5-dialkoxy-4-morpholino-benzene diazonium salt to 4-(dialkylamino)-benzene diazonium salt being in the range of about (5 to 7):1.

4. Diazotype material according to claim 1 in which the light-sensitive layer contains: 2,5-dibutoxy-4-morpholino-benzene diazonium fluoborate, 4-(dipropylamino)-benzene diazonium fluoborate, 6-methoxy-2-hydroxy-3-naphthoic acid-N(3-morpholinopropyl)-amide, 2-methyl-1,3-dihydroxybenzene, and 2,2',4,4'-tetrahydroxy-diphenyl sulfide.

* * * * *